US007063416B2

(12) United States Patent
Laaspere et al.

(10) Patent No.: US 7,063,416 B2
(45) Date of Patent: Jun. 20, 2006

(54) INK-JET PRINTING

(75) Inventors: Jaan Laaspere, Norwich, VT (US); James R. Freedman, Grantham, NH (US)

(73) Assignee: Dimatix, INC, Lebanon, NH (US)

( * ) Notice: Subject to any disclaimer, the term of this patent is extended or adjusted under 35 U.S.C. 154(b) by 117 days.

(21) Appl. No.: 10/459,156

(22) Filed: Jun. 11, 2003

(65) Prior Publication Data

US 2004/0252149 A1 Dec. 16, 2004

(51) Int. Cl.
*B41J 2/01* (2006.01)

(52) U.S. Cl. ..... 347/104; 347/19; 347/102

(58) Field of Classification Search ..... 347/102, 347/104, 54, 8, 16, 4
See application file for complete search history.

(56) References Cited

U.S. PATENT DOCUMENTS 4,825,227 A 4/1989 Fischbeck et al. ..... 346/1.1
4,937,598 A 6/1990 Hine et al. ..... 346/140
5,265,315 A 11/1993 Hoisington et al. ..... 29/25.35
5,365,843 A 11/1994 House et al. ..... 101/228
6,126,273 A * 10/2000 Van Vooren et al. ..... 347/54
6,428,159 B1 * 8/2002 Roy et al. ..... 347/102
6,554,416 B1 * 4/2003 Koto ..... 347/104

* cited by examiner

*Primary Examiner*—Hai Pham

*Assistant Examiner*—Lam S. Nguyen

(74) *Attorney, Agent, or Firm*—Laurence A. Greenberg; Werner H. Stemer; Ralph E. Locher

(57) ABSTRACT

A method of printing which includes providing a print zone and a substrate. The print zone has a print zone length and multiple print regions in which ink drops are sequentially deposited on the substrate. The substrate and the print zone are moved relative to one another while controlling the rate of relative motion such that subsequent drops are deposited after previous drops from an adjacent previous print region have substantially wicked into the substrate and such that the substrate passes the print zone length before the substrate is substantially distorted by cockling.

22 Claims, 5 Drawing Sheets

INK-JET PRINTING

TECHNICAL FIELD

This invention relates to ink-jet printing.

BACKGROUND

In ink-jet printing, ink is ejected from a narrow orifice in the direction of a substrate. In one type of ink-jet printing, known as drop-on-demand printing, the ink is ejected in a series of drops. The drops may be produced and controlled using a piezoelectric ink-jet head that has a large number of orifices. Each orifice is separately controllable to selectively eject ink at desired locations, or pixels, of the image. For example, an ink-jet head may have 256 orifices that have spacing for a printing resolution of at least 100 pixels (dots) per inch (dpi) and sometimes far more than that. This dense array of orifices allows complex, highly accurate images to be produced. In high performance print heads, the nozzle openings typically have a diameter of 50 microns or less (e.g., around 25 microns), are separated at a pitch of 25–300 nozzles/inch, have a resolution of 100 to 3000 dpi or more, and provide drop sizes of about 1 to 70 picoliters (pl) or less. Drop ejection frequency is typically 10 kHz or more. A drop-on-demand piezoelectric print head is described in U.S. Pat. No. 4,825,227, the entire content of which is incorporated herein by reference.

"Cockle" or "cockling" refers to a morphological change (e.g., a dimensional change) in an area of a print substrate caused by the substrate's interaction with ink. Substrate cockle can be detrimental to image quality. One approach used in the office printer field to prevent image distortion effects related to cockle is to limit the coverage of ink disposed on the substrate so that any subsequent cockling minimally distorts the substrate. However, this approach can be limiting, especially in applications requiring high-resolution full-color images. Another approach to the problem of cockle distortion is to use a coated or treated substrate. These substrates typically include additives such as clay, silica, or other materials to produce a glossy paper and inhibits volume-changing interactions with ink, thereby preventing cockling. Coated papers are commonly used in commercial photo ink-jet printers, which produce high-resolution full-color images over, for example, a 6 inch×4 inch or larger area.

Commercial printing is commonly done on multi-color continuous web printing presses. The web, provided, e.g., as a roll of paper, is directed along a paper path that includes separate stations for each color. The web is then slit into sheets and stacked.

SUMMARY

In general, in a first aspect, the invention features a method of printing, including providing a print zone and a substrate, the print zone including multiple print regions in which ink drops are sequentially deposited on the substrate, and moving the substrate and the print zone relative to one another while controlling the rate of relative motion such that subsequent drops are deposited before the substrate is substantially distorted by cockling.

Implementations of the method can include one or more of the following features and/or features of other aspects.

The method can further include moving the substrate and print zone relative to one another such that subsequent drops are deposited after previous drops have substantially wicked into the substrate. The print zone can include four print regions, and each print region can be configured to deposit different colored ink on the substrate. The substrate can be a plain paper substrate (e.g., newsprint paper). The ink can include a solvent (e.g., water or an organic solvent) and a pigment mixed in the solvent.

Drop placement errors due to distortion of the substrate by cockling can be less than about two pixels in length (e.g., less than about one pixel, 0.5 pixels). The maximum cockling magnitude in the print zone can be about 1 millimeter (e.g., less than about 1 millimeter, 500 microns, 300 microns, 200 microns). The rate of relative motion can be more than about one meter per second (e.g., more than about two, three, four, five meters per second). Ink coverage of an area of the substrate can be more than about 50 percent (e.g., more than about 100 percent, 150 percent, 200 percent, 250 percent). Subsequent drops can be deposited within about two seconds of initial drops being deposited (e.g., within about one second, 0.5 seconds, 0.3 seconds, 0.2 seconds).

Each print region can include one or more printhead and the rate of relative motion can be such that where the substrate is substantially distorted by cockling, the substrate does not contact any printhead.

In general, in a further aspect, the invention features a printing system, including a print zone having multiple print regions in which ink drops are sequentially deposited on a substrate as the substrate and the print zone move relative to one another, wherein the rate of relative movement satisfies the relationship $v \geqq L/\tau_c$, where L is the print zone length and $\tau_c$ is a cockling time constant.

Embodiments of the printing system can include one of more of the following features and/or features of other aspects.

$\tau_c$ can be such that the maximum cockling magnitude in the print zone is about 0.5 mm or less departure from substrate planarity at a coverage of about 30% or more. The ink drops can be formed of aqueous ink and the substrate can be plain paper. The substrate can be a continuous web and the printing regions can include print stations arranged sequentially along a web path. The ink drops can be generated by piezoelectric ink jet printheads. The rate of relative motion can also satisfy the relationship $v \leqq l/\tau_w$, where l is a distance between adjacent print regions and $\tau_w$ is a wicking time constant.

In general, in another aspect, the invention features a method of printing, including providing a print zone and a substrate, the print zone including multiple print regions in which ink drops are sequentially deposited on the substrate, and moving the substrate and the print zone relative to one another while controlling the rate of relative motion such that subsequent drops are deposited within a time characteristic of an interaction between the ink and the substrate, wherein ink deposited after the time would result in a distorted image.

Implementations of the method of printing can include one or more of the following features and/or features of other aspects.

The interaction can be a cockling of the substrate. The interaction can be a change in the surface energy of the substrate. A distorted image can have a dot placement error of more than about 0.5 pixels (e.g., more than about one pixel).

Embodiments of the invention may include one or more of the following advantages.

Embodiments can reduce image distortion due to substrate cockle when printing on absorbent substrates, for example, when sequentially printing aqueous inks onto untreated paper. This reduction in distortion can provide for high coverage printing of color images using absorbent substrates, e.g., aqueous inks on newsprint paper. Newsprint paper and aqueous inks can provide a cost savings compared to using treated papers. Moreover, newsprint provides an aesthetic appeal to consumers. In particular, newspaper readers are comfortable with the feel of newsprint. Aqueous ink chemistries are also desirable. For example, aqueous inks are widely available and can avoid environmental problems associated with solvent-based inks.

Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
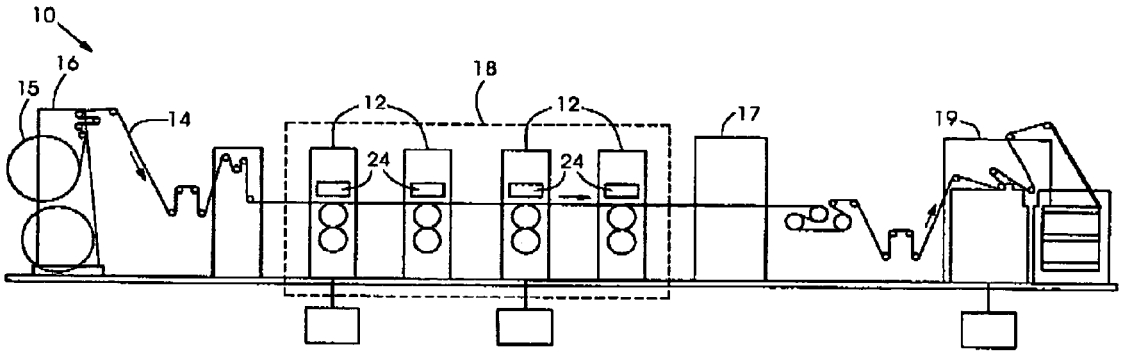
FIG. 1 is a schematic diagram of a continuous web printing press.

Referring to FIG. 1, a continuous web printing press layout 10 includes a series of stations or printing towers 12 for printing different colors onto a moving web 14. The web 14 is driven from a supply roll 15 on stand 16 onto a paper path that leads sequentially to print stations 12. The four print stations define a print zone 18 in which ink is applied to the substrate. An optional dryer 17 may be placed after the final print station. After printing, the web is slit into sheets that are stacked at station 19. For printing wide-format webs, such as newsprint, the print stations typically accommodate a web width of about 25–30 inches or more. A general layout for offset lithographic printing that can be adapted for ink-jet printing is further described in U.S. Pat. No. 5,365,843, the entire contents of which is hereby incorporated by reference.

Figure 2:
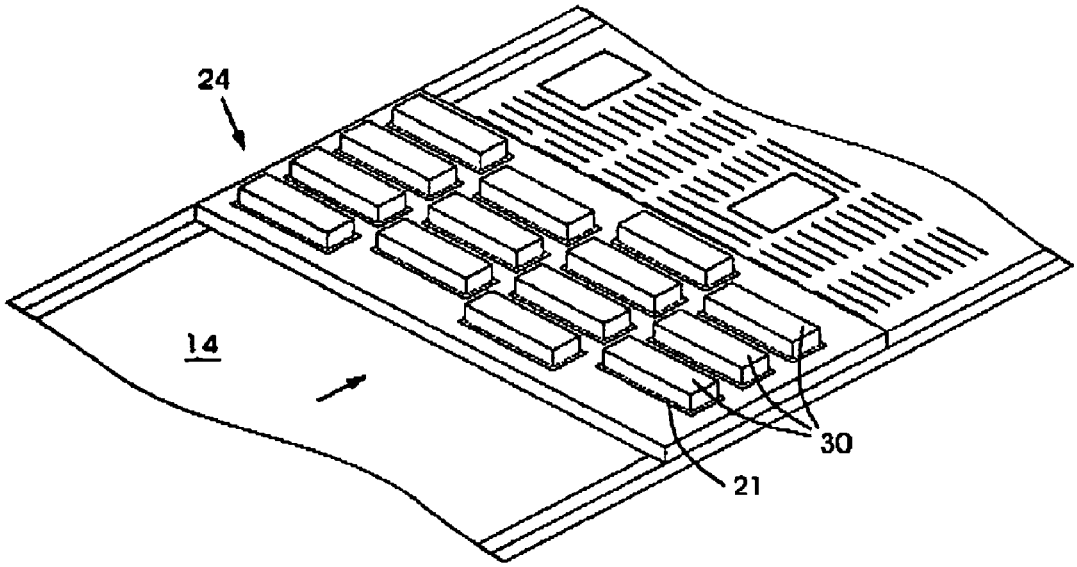
FIG. 2 is a diagram of a print bar housing multiple print heads printing on a continuous web.

Referring also to FIG. 2, each print station includes a print bar 24. The print bar 24 is a mounting structure for print heads 30 which are arranged in an array and from which ink is ejected to render a desired image on the web 14. The printheads 30 are mounted in print bar receptacles 21 such that the faces (not shown in FIG. 2) of the printheads from which ink is ejected are exposed from the lower surface of the print bar 24. The print heads 30 can be arranged in an array to offset nozzle openings to increase printing resolution or printing speed. In a printing condition, the print bar 24 is arranged above the web path to provide proper alignment and a uniform stand-off distance between the print heads 30 and the web 14.

The print heads 30 can be of various types, including piezoelectric drop on demand ink-jet print heads with arrays of small, finely spaced nozzle openings. Piezoelectric ink-jet print heads are described in Hoisington U.S. Pat. No. 5,265,315, Fishbeck et al. U.S. Pat. No. 4,825,227 and Hine U.S. Pat. No. 4,937,598, the entire contents all of which are hereby incorporated by reference. Other types of print heads can be used, such as, for example, thermal ink-jet print heads in which heating of ink is used to effect ejection. Continuous ink-jet heads, that rely on deflection of a continuous stream of ink drops can also be used. In a typical arrangement, the stand off distance between the web path and the print bar is between about 0.5 and one millimeter.

Figure 3A:
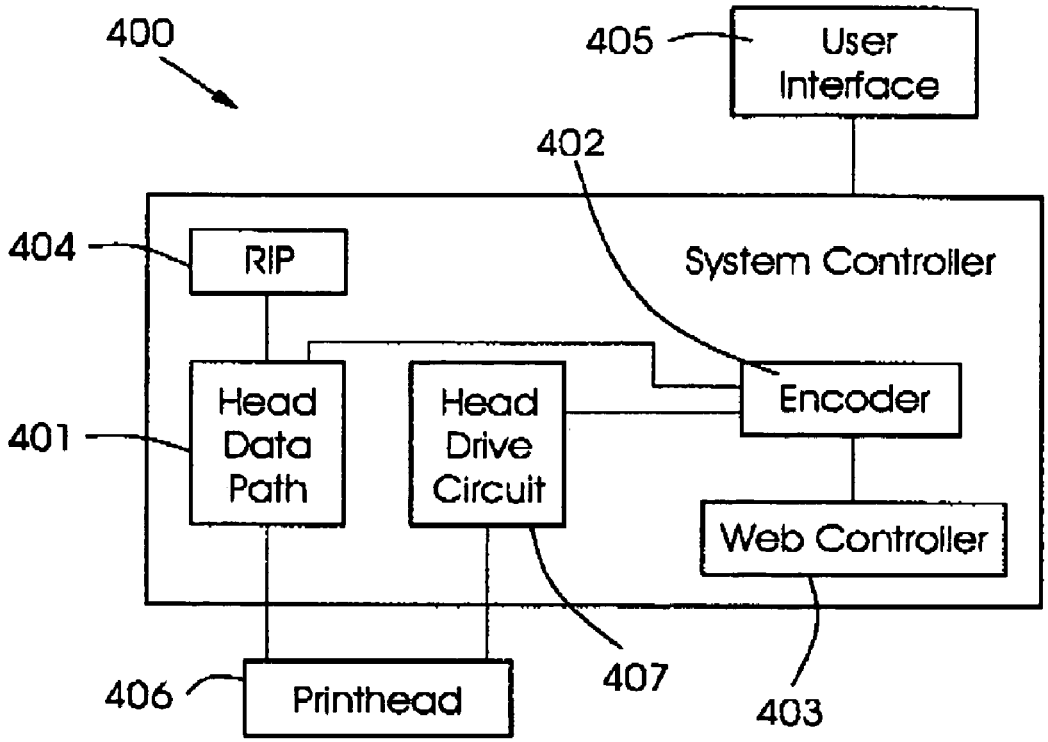
FIG. 3A is a block diagram of a system controller and FIG. 3B is a flow diagram of a control process.
Figure 3B:
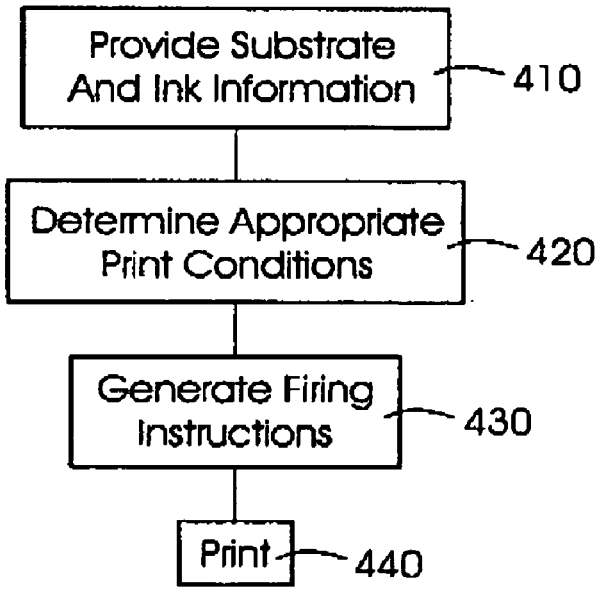

Referring to FIGS. 3A and 3B, a system controller 400 controls the printing process in accordance with the rate and/or magnitude of cockle distortion so that ink is jetted onto the substrate prior to substantial cockling. Substantial image errors caused by incorrect drop placement on the web are reduced or eliminated. Referring particularly to FIG. 3A, the system controller 400 includes a head data path 401, an encoder 402, a web controller 403, a RIP (Raster-Image Processor) system 404, a head drive circuit 407 and an interface 405. The head data path delivers firing instructions to the printheads 406 (one head illustrated) at the print stations to render a desired image on the web. The firing instructions are created in the RIP system 404, which provides the firing instructions based on the desired image color, drop separations, half tones, web speed, etc. The encoder 402 coordinates the firing instructions with a web controller 403, which controls web movement. The encoder also controls head drive circuit 407, which sends a drive voltage waveform to printhead 406. Firing instructions from head data path 401 determine which jets are on and which jets are off for each raster line of the image by appropriately gating the waveform from head drive circuit 407. The interface 405 permits communication with the system. Examples of interfaces are computers, e.g., with a user terminal, communication networks, or manually operated controls for, e.g., web speed selection and/or web and ink type. In embodiments, an image originator (e.g., a desk top publisher) RIPs the image prior to sending it to the system. In such cases, RIP system 404 re-RIPs the image data as necessary based on the printing conditions.

Referring particularly to FIG. 3B, in operation, the system controller 400 is provided with substrate and ink type information through the interface (410). The system controller determines the appropriate conditions in accordance with the rate and/or magnitude of cockle distortion so that image errors are reduced (420). In some embodiments, the input to the system controller is the web type, ink type, and/or ink coverage. The system controller consults a look-up table that, based on the cockle distortion rate, provides a web feed rate at which the images can be printed without substantial image errors due to cockle distortion. The RIP system generates firing instructions (430), which specify which jets are to fire for each print row. The firing instructions are controlled by the encoder, which sends triggering signals to the printhead via the head data path. The encoder generates the triggering signals for the firing instructions based on the web motion, which it measures directly. The triggering signal frequency corresponds to the frequency with which the firing instructions are sent to the printhead during printing (440).

Figures 4A, 4B, 4C, 4D:
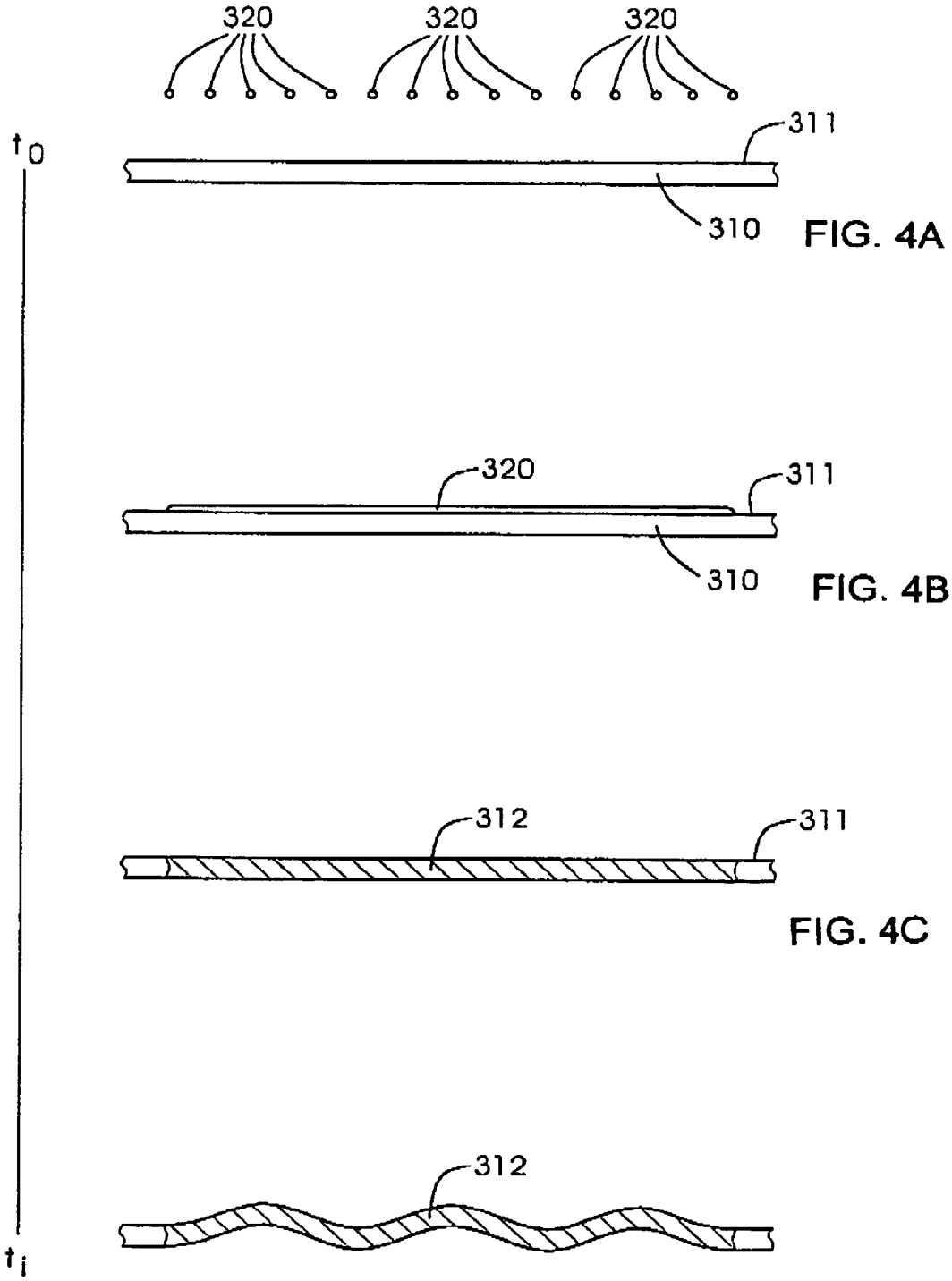
FIG. 4A–4D are schematic diagrams illustrating different stages of ink interaction with a substrate.

Referring to FIGS. 4A–4D, the substrate does not cockle instantaneously upon contact with the ink. Rather, there exists a time constant, $\tau_c$, for the interaction of the substrate 310 with ink drops 320 associated with the ink wetting and wicking into the paper and subsequent volume change that manifests as cockle distortion. Without wishing to be limited to theory, it is believed that upon contacting the substrate surface 311 (FIG. 4A), ink drops 320 contact and initially wet surface 311 without substantially penetrating substrate 310 (FIG. 4B). Due to the interaction between the ink and the substrate fibers, the ink wicks into the body 312 of substrate 310 (FIG. 4C). At this stage, the ink coats the paper fibers without substantially penetrating them, so there is little volume change and no significant cockling. However, the coated paper fibers subsequently absorb the ink, causing volume 312 to swell and the substrate to cockle (FIG. 4D).

Figure 5:
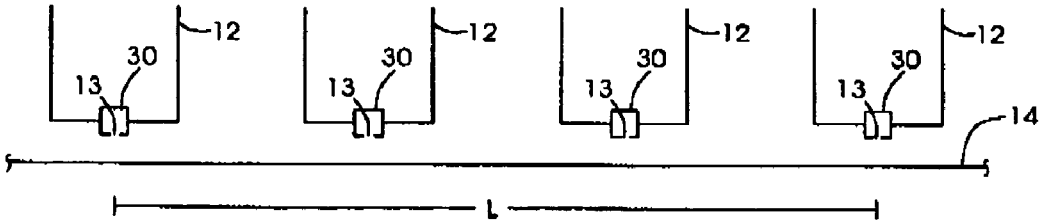
FIG. 5 is an enlarged view of a print region.

Referring to FIG. 5, an enlarged view of the print zone 18, each print station 12 includes a series of printheads 30 each having nozzles 13 (a single printhead each having a single nozzle is illustrated for each print station). The print zone length, L, is the distance between the first nozzle in the first print station along the paper path to the last nozzle in the last print station along the paper path. For a cockle time constant, $\tau_c$, the web feed rate, v, satisfies the relationship $v \geqq L/\tau_c$, where L is the print zone length. This ensures that printing from all print stations will be completed within a period shorter than the time it takes for the paper to cockle in response to the printing. Alternatively, or additionally, the length of the print zone can be adjusted to satisfy the foregoing relationship.

In some embodiments, the cockle time constant and web feed rate are such that the web is also clear of portions of print stations that would otherwise be impacted by the web due to cockling before the paper cockles. For example, where a printhead surface is positioned close to the web (e.g., less that 1 mm from the web), cockle that occurs after the web emerges from the print zone could cause the web to impact down-web portions of the printhead. Thus, the web feed rate and print station arrangement should be designed so that substantial cockle only occurs after the web clears the printhead portions that are close to the web.

In certain embodiments, where each print station jets an ink having a different interaction time constant with the paper, the print stations can be arranged so that the ink with longer time constant are jetted prior to inks with relatively shorter time constants.

This relationship between the web feed rate and the ink-substrate interaction time accommodates the negative effects of substrate cockle by running the web at a sufficient velocity and/or reducing the print zone length. However, printing on wet ink before it wicks into the paper can also cause negative printing effects (e.g., bleeding between different colors). A wick time constant, $\tau_w$, can be associated with the time it takes for an ink drop to wick into the paper. The web velocity is selected to satisfy $v \leqq l/\tau_w$, where l is the distance between adjacent print stations. Thus, for a web-based printing line, such as illustrated in FIG. 1, where l and L are fixed, the interaction between the ink and the paper provide a window of web velocities within which effects of cockling and printing on wet ink can be reduced (e.g., minimized).

The ink-substrate interaction time depends on the ink type, the substrate type and the ink coverage. The ink can be various types, including solvent-based, hot-melt or aqueous ink. An aqueous ink includes a pigment or a dye suspended in a carrier that includes a substantial amount of water (e.g., five percent by weight or more). More typically, the carrier in aqueous inks includes more than about 35 percent water, such as 80–90 percent or more. Often, aqueous ink carriers also include a substantial amount of glycol (e.g., more than about five percent by weight, such as 50 percent or more). Aqueous inks are desirable because of their low cost and they reduce or eliminate the use of organic solvents. The substrate type can be a coated or treated paper or uncoated paper. Uncoated or plain paper, such as newsprint, is substantially free of clay or silica additives, and is available at low cost.

Ink coverage refers to the fraction of ink provided by each print station with compared to the maximum amount the station could provide. For example, ink coverage of 50 percent corresponds to printing ink from one station on half the available pixels in the area for one side of an area of paper. Thus, for a four-station printing press, such as the press shown in FIG. 1, maximum possible coverage is 400 percent, although coverage rarely exceeds 300 percent for practical purposes. This doubles when printing on both sides of the web. The amount of coverage at which detrimental cockling effects begin to manifest depend on the type of paper and ink, as well as the ink drop volume per pixel. When printing aqueous ink on newsprint-type paper, noticeable image distortion can manifest for coverage as low as about 30 percent. However, full-color images often utilize ink coverage in excess of 30 percent (e.g., between about 200 and 300 percent). Accordingly, printing prior to cockling can enable continuous web-based printing of full-color images on standard newsprint paper with minimal image distortion.

The type of ink and/or paper used can be selected according to their cockle time constant. Cockle time constant can be determined by observing the rate and magnitude of cockle distortion for a given ink coverage. The maximum acceptable cockling magnitude can be determined based on the desired image quality and other process characteristics. For example, in order to avoid contact between the web and the printhead that may damage the heads and cause subsequent image distortion, the maximum cockling magnitude in the print zone should not be greater than the stand off space between the substrate guide and the printhead nozzles. For high resolution ink jet printing using, e.g., piezoelectric printheads, the standoff distance is typically 1 mm or less, e.g., about 0.5 mm. The maximum cockling magnitude can be, for example, 50 percent, 20 percent, 10 percent or five percent or less of the standoff distance. The maximum cockling magnitude can also be determined on the basis of departure from web planarity. For example, the maximum departure from planarity can be about 0.7 mm, 0.5 mm, or 0.1 mm or less. The maximum cockling magnitude can also be delivered on the basis of image error. In embodiments, the cockle time constant can be more than about 0.1 seconds (e.g., 0.5 seconds, one second, two seconds, three seconds, or more). The maximum cockling magnitude can also be determined by the image error, which can be determined by visual examination or by quantitative dot placement error. Dot placement error refers to a distance of a jetted drop location from a target location on the substrate. Dot placement error can be measured in pixels. Typically, dot placement errors become apparent between about one and two pixels in length, although depending on the printing system and the image, errors can be apparent for dot placement errors as low as about 0.5 pixels in length. Drop placement error can be determined using microscopic inspection of images printed on a test target. Such inspection can be substantially automated, using commercial or customized image analysis techniques. Alternatively, or additionally, dot placement error can be determined using visual inspection of completed images. By completing printing before any substantial paper cockling, images with high ink coverage (e.g., more than about 50 percent, 75 percent, 100 percent, 150 percent, 200 percent) can be printed on absorbent substrates with drop placement errors of less than about two, such as 0.5 pixel lengths for errors due to cockling.

Alternatively, or additionally, the type of ink and/or paper used can be selected to have relatively short wick time constant with respect to the cockle time constant. For example, the ratio of the wick time constant to cockle time constant can be less than about 0.2 (e.g., less than about 0.1, 0.05). In some embodiments, the wick time constant can be less than about 0.5 seconds (e.g., 0.1 seconds, 0.05 seconds, 0.01 seconds or less). To further illustrate this velocity window, consider an example where L is 1.5 meters and l is 0.5 meters. Given a cockle time constant $\tau_c$ 0.5 seconds and a wick time constant $\tau_w$ 0.05 seconds, the velocity window is from 3 meters per second ($v \geqq 1.5/0.5$) to 10 meters per second ($v \leqq 0.5/0.05$).

In some embodiments, in order to complete printing between the ink drops wicking into the substrate and the substrate cockling, the web velocity can be between about one and five meters per second (e.g., between about two and three meters per second)

The velocity window for a printing line can be determined by measuring the time constants for the ink/paper combination to be used. Alternatively, or additionally, the velocity window can be determined empirically during a setup phase prior to a printing run. In order to determine an appropriate web velocity (or range of velocities), the line operator can run the line at several different velocities printing a test image having coverage corresponding to a maximum anticipated coverage for the printing run. Upon subsequent examination of the test images, the operator can select the web velocity corresponding to the best image.

Although the foregoing description addresses techniques for avoiding image distortion due to substrate cockle, the methods disclosed herein can be applied to other interactions between ink and the substrate as well, including chemical and physico-chemical interactions. In particular, the disclosed methods can be applied to interactions between the ink and substrate that have a characteristic interaction time and provide a time window during which additional ink can be deposited on the same area of the substrate without substantial image distortion. For example, an ink may interact with the substrate to alter the surface energy of the substrate. Altered surface energy may cause subsequent ink drops to wet the surface in a way that results in undesirable image distortion. Where such an interaction occurs with a characteristic time constant, substantial image distortion can be avoided by depositing the additional ink within the period defined by the time constant.

EXAMPLES

The following studies were performed using UPM Norm C 45 g/m$^2$ newsprint paper obtained from Heidelberger Druckmaschinen AG (Heidelberg, Germany) and an aqueous fluid mixture of 65 wt. % 1,2-propanediol (from Acros Organics supplied by Fisher Scientific, Suwanee, Ga.), 0.25 wt. % BYK-333 surfactant (from BYK Chemie, Wallingford, Conn.) and 35 wt. % deionized water.

Example 1

Observation of Cockling Due to Aqueous Ink Coating of Newsprint

1. Newsprint paper samples were coated with an aqueous fluid using a drawdown coater (an RK Print-Coat Instrument, which was obtained from RK Print Coat Instruments Ltd., Herts, United Kingdom. A #0 bar was selected for coating, and the coater speed setting was set to 10. According to the coater manufacturer's calibration table, this bar and speed provided a coating thickness of approximately 6–8 microns. A small volume of fluid (e.g., 2–3 cm$^3$) was pipetted onto the coating bar that was placed on top of a sheet of newsprint. Upon activation, the coater drew the wet coating bar across an area of the newsprint sheet, applying a coating of the fluid to the area. Visual observation of the coated newsprint revealed significant distortion of the paper within one second of the coating. This time was determined by first measuring the time for the bar to complete its coating cycle and then observing the paper at the end of the cycle.

Example 2

Video Observation of Cockling During Spray Coating

Aqueous fluid was sprayed using an aerosol spray nozzle (model no. 1/4 JCO-SS-SV13A-SS obtained from Spraying Systems Co. (Wheaton, Ill.) onto a 4 inch by 5 inch surface area of newsprint paper samples. A plexiglass frame was used to mask off all but a 4×5 inch window of each sample. The air pressure and liquid pressure of the aerosol were adjusted to provide a coating thickness of approximately 10–12 microns, as determined by placing a Mettler Toledo PB303 scale (obtained from Fisher Scientific) in the same location as the paper and directly weighing an equivalent amount of sprayed liquid. Two fiber optic lamps (FiberLite Model PL800obtained from Cole Parmer, Vernon Hills, Ill.) were positioned approximately one inch above the paper surface, eight inches from the exposed paper, thereby illuminating the exposed paper portion at an oblique angle, with the two lights oriented approximately 90 degrees from each other. A video camera (from Sony) was positioned directly above the paper. During the aerosol coating, the exposed surface was illuminated with the fiber optic lamps while the video camera recorded an image of the exposed surface. The camera frame rate was approximately 30 Hz. A frame-by-frame visual analysis of the recorded video footage was performed, and changes in the paper morphology were determined by the extent of shadows formed due to paper distortions occluding light from the lamps.

The frame-by-frame analysis revealed substantially no change in the paper in the first 300 milliseconds after coating. A noticeable change occurred within 500 milliseconds, and pronounced change was observed by one second after coating.

Still further embodiments are within the following claims.

What is claimed is:

1. A method of printing, comprising:

providing a print zone and a substrate, the print zone having a print zone length and multiple print regions in which ink drops are sequentially deposited on the substrate; and moving the substrate and the print zone relative to one another while controlling the rate of relative motion such that subsequent drops are deposited after previous drops from an adjacent previous print region have substantially wicked into the substrate and such that the substrate passes the print zone length before the substrate is substantially distorted by cockling.

2. The method of claim 1, wherein the print zone comprises four print regions.

3. The method of claim 2, wherein each print region is configured to deposit different colored ink on the substrate.

4. The method of claim 1, wherein the substrate is a plain paper substrate.

5. The method of claim 4, wherein the paper substrate comprises newsprint paper.

6. The method of claim 1, wherein the ink comprises a solvent and a pigment mixed in the solvent.

7. The method of claim 6, wherein the solvent comprises water.

8. The method of claim 6, wherein the solvent is an organic solvent.

9. The method of claim 1 wherein the maximum cockling magnitude in the print zone is about 1 millimeter.

10. The method of claim 1, wherein the rate of relative motion is more than about one meter per second.

11. The method of claim 1, wherein ink coverage of an area of the substrate is more than about 50 percent.

12. The method of claim 1, wherein subsequent drops are deposited within two seconds of initial drops being deposited.

13. The method of claim 12, wherein subsequent drops are deposited within one second of initial drops being deposited.

14. The method of claim 1, wherein each print region comprises one or more printhead and the rate of relative motion is such that where the substrate is substantially distorted by cockling, the substrate does not contact any printhead.

15. A printing system, comprising a print zone including multiple print regions in which ink drops are sequentially deposited on a substrate as the substrate and the print zone move relative to one another;

wherein the rate of relative movement satisfies the relationship $v \geqq L/\tau_c$, where L is the print zone length and $\tau_c$ is a cockling time constant; and wherein the rate of relative motion also satisfies the relationship $v \leqq l/\tau_w$, where l is a distance between adjacent print regions and $\tau_w$ is a wicking time constant.

16. The printing system of claim 15 wherein $\tau_c$ is such that the maximum cockling magnitude in the print zone is about 0.5 mm or less departure from substrate planarity at a coverage of about 30% or more.

17. The printing system of claim 16 wherein the ink drops are formed of aqueous ink and the substrate is plain paper.

18. The printing system of claim 17 wherein the substrate is a continuous web and the printing regions comprise print stations arranged sequentially along a web path.

19. The printing system of claim 18 wherein the ink drops are generated by piezoelectric ink jet printheads.

20. A method of printing, comprising:

providing a print zone and a substrate, the print zone having a print zone length and multiple print regions in which ink drops are sequentially deposited on the substrate; and moving the substrate and the print zone relative to one another while controlling the rate of relative motion such that subsequent drops are deposited after previous drops from an adjacent previous print region have substantially wicked into the substrate and such that the substrate passes the print zone length within a time characteristic of an interaction between the ink and the substrate, wherein ink deposited after the time would result in a distorted image.

21. The method of claim 20, wherein the interaction is a cockling of the substrate.

22. The method of claim 20, wherein the interaction is a change in the surface energy of the substrate.

* * * * *

UNITED STATES PATENT AND TRADEMARK OFFICE

CERTIFICATE OF CORRECTION

PATENT NO. : 7,063,416 B2
APPLICATION NO. : 10/459156
DATED : June 20, 2006
INVENTOR(S) : Jaan Laaspere et al.

It is certified that error appears in the above-identified patent and that said Letters Patent is hereby corrected as shown below:

On Title Page,
Item [73] should read as follows:

Assignees: Dimatix, Inc. Lebanon, NH (US)

Heidelberger Druckmaschinen AG
Heidelberg, Germany (D)

Signed and Sealed this

Sixth Day of February, 2007

JON W. DUDAS
*Director of the United States Patent and Trademark Office*